United States Patent [19]

Murase et al.

[11] 4,109,181

[45] Aug. 22, 1978

[54] DRIVING SYSTEM AND METHOD FOR SHIFTING A DISCHARGE SPOT IN A PLASMA DISPLAY PANEL

[75] Inventors: Kenji Murase; Sei Sato; Hisashi Yamaguchi; Hirofumi Kashiwara, all of Hyogo, Japan

[73] Assignee: Fujitsu Limited, Kawasaki, Japan

[21] Appl. No.: 782,454

[22] Filed: Mar. 29, 1977

[30] Foreign Application Priority Data

Mar. 29, 1976 [JP] Japan ..... 51-34626

[51] Int. Cl.[2] ..... H05B 37/00; H05B 39/00; H05B 41/00

[52] U.S. Cl. ..... 315/169 TV; 340/324 M

[58] Field of Search ..... 315/169 TV; 340/324 M, 340/166 EL

[56] References Cited

U.S. PATENT DOCUMENTS

| | | | |
|---|---|---|---|
| 3,878,430 | 4/1975 | Hirose | 315/169 TV |
| 3,976,993 | 8/1976 | Hirose et al. | 340/324 M |

*Primary Examiner*—Alfred E. Smith
*Assistant Examiner*—Robert E. Wise
*Attorney, Agent, or Firm*—Staas & Halsey

[57] ABSTRACT

An improved driving system and method for shifting a discharge spot from a given discharge cell to an adjacent discharge cell in an A.C. gas discharge, or plasma display, panel, having opposed sets of electrodes respectively covered with corresponding dielectric layers thereby insulated from the discharge gas space. One set of electrodes comprises common electrodes extending in parallel relationship and defining the direction of propagation of the shifted discharge spots. The other set of electrodes, spaced apart from the first set by the gas space, extends in parallel relation transversely to the first common electrodes, and comprise the shift electrodes. The shift electrodes are arranged in groups of a predetermined number in each group and a corresponding number of buses permits selective application of shift pulses to the respectively associated shift electrodes in sequence for each group and simultaneously for the successive groups. An improved operating margin for the shift function is achieved by utilizing the priming discharge effect of a given cell currently discharging, to reduce the necessary firing voltage at an adjacent discharge cell to which the current discharge spot is to be shifted, while minimizing the probability of misfiring at corresponding, remote cells energized in the same phases. An overlap pulse is applied to a discharge cell at which a discharge spot currently is established, to provide a priming discharge for the adjacent cell to which the spot is to be shifted. A shift pulse applied to the adjacent cell terminates after termination of the overlap pulse and thereby produces a lateral field between the two adjacent discharge cells whereby the space charge generated by the priming discharge is attracted to and reduces the necessary firing voltage at the adjacent cell. The duration of the overlap pulse in relation to the amplitude of the shift pulse defines an operating margin for the shift operation which is optimized over a preferred range of the overlap pulse duration.

36 Claims, 10 Drawing Figures

(CELL POTENTIAL)

(ELECTRODE POTENTIAL)

DRIVING SYSTEM AND METHOD FOR SHIFTING A DISCHARGE SPOT IN A PLASMA DISPLAY PANEL

BACKGROUND OF THE INVENTION

1. Field of the Invention

This invention relates to an improved system and method for shifting a discharge spot in an A.C. type discharge panel and, more specifically, to such system and method for improving the shift operation, including maximizing the shift operating margin.

2. Description of the Prior Art

Gas discharge panels known in the prior art as Self-Shift Plasma Display Panels, provide the function of shifting the discharge spot from a given cell to an adjacent cell. An example of such a panel is described in detail in U.S. Pat. No. 3,944,875 — Owaki et al. assigned to a common assignee herein. Briefly, the self-shift plasma display panel described in this patent has an electrode configuration corresponding to that shown herein in FIG. 1.

In the prior art panel arrangement of FIG. 1, common electrodes *y*1 to *y*5, extending in a horizontal direction, are connected to a common bus *yc* in turn connected to a terminal Y. Although not illustrated in FIG. 1 to permit clarity of illustration of the electrode structure, the common electrodes *y*1–*y*5 are deposited on a substrate and have extending thereover a dielectric layer to insulate same from the discharge space. The panel further includes a second set of shift electrodes arranged in groups and illustrated in FIG. 1 by *a*1–*d*1 comprising a first group, *a*2–*d*2 comprising a second group, . . . and *an*–*dn* comprising an *n*th group. The corresponding electrodes *a* of each group are connected in common to a bus BA connected to a terminal A. Similarly, buses BB, BC, and BD are connected to the corresponding electrodes "*b*", "*c*", and "*d*", and in turn are connected to corresponding terminals B, C and D, respectively. As is apparent, the shift electrodes *a, b, c,* and *d* of all of the groups extend in generally parallel relation transversely to the common electrodes *y* and are formed on a second substrate as well including a dielectric layer overlying the electrodes and insulating same from the gas discharge space. The intersections of the shift electrodes and the common electrodes define discharge cells. Sequential application of shift voltages to the terminals A, B, C, and D causes shifting of a discharge spot from a given discharge cell in sequence to the respectively next adjacent cells as defined by the corresponding shift electrodes extending along the associated common electrode. Due to the respective, sequential application of the shift voltages to the terminals A to D, the shift voltages are frequently identified as being of phases A to D. Hence, the corresponding electrodes of each group receive the same phase shift voltage simultaneously.

The panel of FIG. 1 additionally includes a set of write electrodes *w*1 to *w*5 connected to corresponding terminals W1 to W5, respectively, which are disposed closely adjacent the initial shift electrode *a*1 of the first group of the set of shift electrodes. The write electrodes *w*1 to *w*5 respectively correspond to the common electrodes *y*1 to *y*5. The write electrodes would be provided on the same substrate and insulated from the gas discharge space by the same dielectric layer as that employed for the shift electrodes.

The panel, as is well known, is sealed and filled with an ionizable gas.

Accordingly, as above noted, each of the intersections of the write electrodes and the shift electrodes with the various common electrodes defines a discharge cell. Once a discharge, or discharge spot, is initiated in a given discharge cell, it can be shifted along the direction of the associated common electrode by the sequential application of shift pulses to the successive shift electrodes of each group, and for the successive groups of shift electrodes. Thus, the write electrodes are used to create initial discharges corresponding to information desired to be displayed and those discharges are shifted to desired positions in the panel or, in some cases continuously shifted throughout the length of the panel. New information may be written in for display as the previously written information is advanced, by shifting across the panel.

Where display of the information written into the panel is desired to be maintained at a given panel position, the shift voltage pulses may be supplied continuously to the shift electrodes at which the discharge spots displaying that information currently have been shifted, or in accordance with a further technique, a shift voltage may be applied alternately to two adjacent ones of the successive shift electrodes by application of alternate shift voltage pulses to the corresponding buses associated with those shift electrodes. In this regard, the shift voltage pulses may act as sustain voltage pulses to maintain the display.

The shifting of the discharge spot in a gas discharge panel, as is well known, is achieved by making use of the so-called priming effect. Specifically, when a discharge spot is generated at a given discharge cell, that discharge has a primary current, or priming effect, on the adjacent discharge cell due to the space charge created by the existing discharge, that space charge being formed of electrons, ions, and metastable atoms generated by the existing discharge at the given discharge cell. This space charge or priming effect serves to lower the firing voltage at an adjacent discharge cell below that level of firing voltage which otherwise would be necessary to create a discharge at the adjacent discharge cell. As a result, the lower limit, or minimum value, of the shift voltage required in a shift operation as above described is determined by this reduced value of firing voltage at the adjacent discharge cell resulting from the priming effect of the current discharge at the given cell. Conversely, this priming effect also sets an upper limit, or maximum value, of the permissible shift voltage pulse level, as determined by the firing voltage of a remote discharge cell receiving the same phase shift voltage pulse, and thus at the same time as the referenced adjacent cell intended to receive the discharge, by virtue of the common bus arrangement, to prevent misfiring, and to assure cancellation of the wall charge of the given discharge cell from which the discharge spot is shifted.

Specifically, with reference to FIG. 1, if the given cell illustrated at the circle P1 in FIG. 1 is currently undergoing a discharge and thus maintained in a "ON" condition, holding the discharge spot, the magnitude of the shift voltage pulse to be applied to the adjacent discharge cell defined by the circle P2 to which the discharge spot is to be shifted must be selected to be of a voltage level in accordance with the following conditions. First, the lower limit of that voltage level of the shift pulse must be greater than the firing voltage V*f*1 at the discharge cell P2; as noted, the priming effect of the discharge cell P1 will cause a relative reduction in the normal firing voltage level required to create a discharge at the cell P2 in the absence of such priming discharge. Conversely, the shift pulse applied to cell P2 must be less than a level at which a discharge would be created at the cell P2' defined by the corresponding electrode *b*2 of the adjacent group (2) of shift electrodes. Specifically, the cells P2 and P2' simultaneously receive the same shift pulse phase through their respective shift electrodes *b*2 and *b*3 from the common bus BB. The level of the shift voltage which could create a discharge at cell P2' may be defined as $V_f3$.

Thus, under the condition of a given cell P1 undergoing discharge, the shift voltage for shifting that discharge to the adjacent cell P2 requires that the shift voltage be of a level exceeding the minimum firing voltage $V_f1$ at the adjacent cell P2 to which the discharge is to be shifted, but must be lower than the level $V_f3$ such as would create a discharge at the remote cell P2' which corresponds to the cell P2 but is in a different group of the shift electrodes. The difference of these firing voltage levels, ($V_f3$-$V_f1$) as defined by the adjacent, and the corresponding, remote discharge cells P2 and P2' (i.e., the "corresponding" cells being those energized from a common phase shift voltage over the same shift bus) defines the shift operating margin of the panel.

The shift operating margin of the panel thus is a critical condition in prior art shift-type plasma display panels, introducing corresponding difficulties in the manufacture and operation of such panels, including the driving circuitry therefor.

SUMMARY OF THE INVENTION

Accordingly, it is an object of this invention to provide a shift-type plasma display panel having a substantial improvement, or increase, in the operating margin for the shift operation of the discharge spot.

Another object of the present invention is to provide an improved method for shifting a discharge spot which affords stable and reliable shift operations.

A still further object of the present invention is to provide a highly effective system and method for shifting a discharge spot from one discharge cell to an adjacent discharge cell defined by two adjacent, successive shift electrodes and a transversely extending, common electrode.

Yet another object of the present invention is to provide an improved method and system for an A.C. gas discharge panel having an array of discharge cells defined by spaced electrodes and particularly for a self-shift type of plasma display panel.

The present invention accordingly provides an improved method and system for shifting discharge spots in an A.C. type gas discharge panel. Such a panel typically includes one set of common electrodes extending in parallel and disposed on a corresponding substrate and insulated from a gas discharge space by a suitable dielectric layer. A second set of parallel, shift electrodes extends in parallel relation transversely to the first set of common electrodes and likewise is disposed on a corresponding substrate and insulated from the gas discharge space by a suitable dielectric layer. The two transversely related sets of electrodes, thus separated by the gas discharge space and insulated therefrom by the corresponding dielectric layers, define at their intersections, discharge cells. A discharge formed in a given cell between a given one of the common electrodes and one of the shift electrodes then is advanced or shifted to a successive, adjacent cell by the application of a shift voltage of the corresponding, next phase, to that adjacent cell.

In accordance with the invention, the priming effect of the currently discharging cell due to its space charge is utilized to advantage in the shift operation for establishing a discharge at the adjacent cell; moreover, an undesired priming effect on a corresponding discharge cell along that same common electrode, but defined by the corresponding shift electrode of a different group of the shift electrodes, is minimized. Specifically, the shift electrodes are arranged in groups of a predetermined number, corresponding ones of the electrodes of each such group being connected to a common shift bus for receiving shift voltages applied thereto. Thus, a shift pulse of the proper phase for shifting the discharge from a given to the adjacent cell is applied simultaneously to the corresponding electrodes of each of the groups, and thus to the remote cells corresponding to that adjacent cell to which the discharge is to be shifted, as defined by corresponding shift electrodes of the other groups.

Specifically, in a shift cycle of operation, a shift pulse is applied to the adjacent cell to which the discharge is to be shifted. During the time duration of that shift pulse, an "overlap" pulse is applied to the given cell which currently is discharging and from which the discharge is to be shifted. That overlap pulse is controlled to terminate prior to termination of the shift pulse. There results a lateral field effect between the adjacent cell and the given cell, thereby attracting electrons from the currently discharging cell to the adjacent cell which is to receive the shifted discharge, and promoting the firing, or discharging, at the adjacent discharge cell which is to receive the discharge spot. This termination of the overlap pulse prior to that of the shift pulse also minimizes the undesired priming effect of the existing discharge on the corresponding remote discharge cells and as well assists in the elimination of the wall charge at the given cell from which the discharge is being shifted, thereby to assist in preventing misfires and in general to improve the operating margin of the shift function.

The invention will be better understood as to the above and other objects thereof, and as to its details from the following detailed description of one preferred embodiment thereof, taken with reference to the following drawings.

DESCRIPTION OF THE PREFERRED EMBODIMENTS

Figure 1:
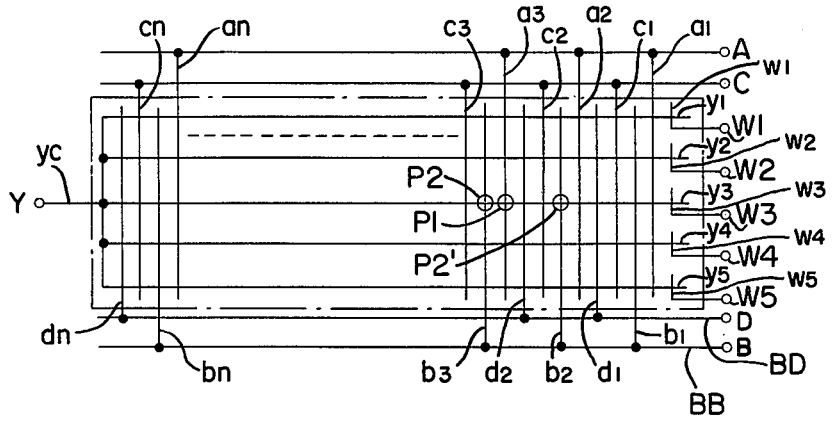
FIG. 1. (PRIOR ART)
FIG. 1 shows a typical electrode arrangement of a self-shift plasma display panel of the prior art, and to which the method and system of the present invention may be applied for improving the shifting operations therein.
Figure 2A:
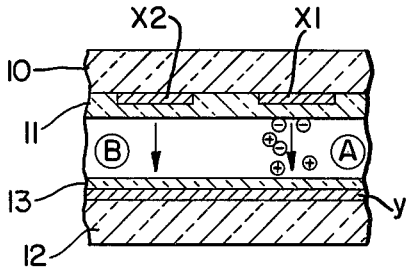
FIGS. 2A and 2B, respectively, show in diagrammatic fashion cross-sectional views of a plasma display panel with respect to a given cell at which a discharge is occurring and an adjacent cell to which the discharge is to be shifted, to facilitate an explanation of the principal of the method of the invention.
Figure 2B:
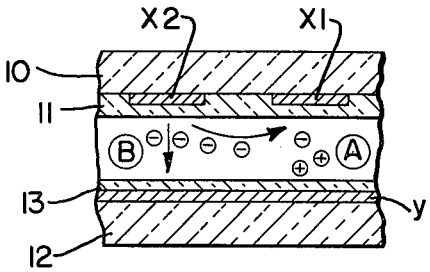

Whereas FIG. 1 illustrates a prior art plasma display panel with which the method and system of the present invention may be employed, the invention will be better understood with reference initially to FIGS. 2A and 2B which show in cross section two adjacent cells A and B of a plasma display panel of the type of FIG. 1, for illustrating important discharge conditions occurring during a shift operation in accordance with the method of the present invention. Reference will also be made concurrently to FIG. 3A which illustrates the waveforms of the cell potentials occurring within adjacent cells and to FIG. 3B which illustrates the waveforms of the pulse voltages for producing those cell potentials as applied to the shift electrodes and as well a steady straight ground potential applied to the common electrode with which those discharge cells are associated, in a shift operation.

In FIGS. 2A and 2B, a plasma display panel includes a first substrate 10 to which there are applied electrodes $x1$ and $x2$ and a covering dielectric 11 and a second substrate 12 to which there are applied a common electrode $y$ with a covering dielectric 13, the dielectric layers 11 and 13 bordering on and defining therebetween a gaseous discharge space, all in accordance with known prior art configurations of such devices. Common electrode $y$ corresponds to any of the common electrodes $y1$ to $y5$ of FIG. 1 and electrodes $x1$ and $x2$ correspond to any of the adjacent write ($w1$ to $w5$) and shift ($a1$ to $d1$, . . . $an$ to $dn$) electrodes of FIG. 1.

Figure 3A:
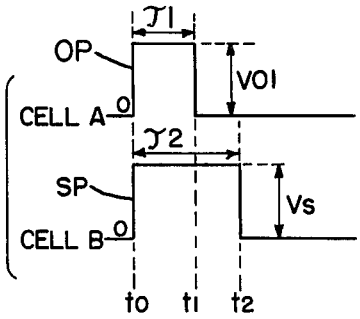
FIG. 3A, is a waveform plot of the discharge cell potentials
Figure 3B:
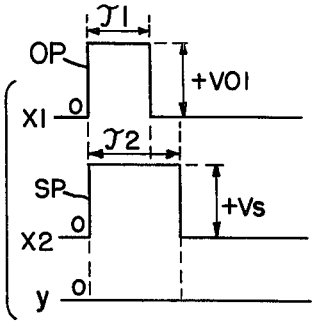
FIG. 3B is a corresponding waveform plot of the pulse voltages OP and SP applied to the shift electrodes and a ground level voltage applied to the common electrode, for the illustrative cells of FIGS. 2A and 2B.

In FIG. 3B, the pulse voltage OP is applied to the electrode $x1$ and the pulse voltage SP is applied to the electrode $x2$, the common electrode $y$ being held at ground potential "0". Although other arrangements may be employed, it is sufficient that these pulse voltages OP and SP be applied as positive voltages to the shift electrodes $x1$ and $x2$ while the common electrode $y$ is clamped to ground potential. There results cell potentials of corresponding waveform configurations as shown in FIG. 3A and specifically cell potentials OP and SP corresponding to the cells A and B as labelled in FIGS. 2A and 2B.

As shown in FIG. 3A, pulse voltage OP applied to cell A has a duration or pulse width $\tau 1$ and an amplitude or voltage value of V01, while the shift pulse SP applied to the discharge cell B has a pulse duration or width $\tau 2$, greater than $\tau 1$, and an amplitude level Vs. As later described, the pulse OP need not be initiated simultaneously with the pulse SP; however, for purposes of the present invention, it is important that the pulse OP terminates prior to termination of the pulse SP.

Where time $t$ is defined by $t_0<t<t_1$, then, during the common or ovelap period of the two pulses OP and SP, common electric fields are established in the cells A and B as illustrated by the arrows in FIG. 2A. In this condition, and prior to any shift of a discharge spot to cell B, cell A undergoes discharge and information is stored on the dielectric layers associated with cell A in the form of a wall charge.

When the time $t$ has advanced to the relation: $t_1<\lambda t<t_2$, the potential of the electrode $x1$ has been reduced to ground level in accordance with the termination of the OP pulse at time $t1 = \tau 1$, and there results a lateral field between the shift electrodes $x2$ and $x1$ as indicated in FIG. 2B. Cell A which is currently undergoing discharge creates a space charge and the lateral field acts thereupon to attract electrodes from this priming discharge of cell A to the positive potential existing on the electrode $x2$ by virtue of the positive value of the shift pulse SP relative to the potential of electrode $x1$ as seen in FIG. 3A. Thus, electrons are attracted from the space charge produced in cell A into the discharge cell B. Thus, the firing voltage of discharge cell B is considerably reduced and, as a result thereof, the discharge spot is shifted readily by the shift voltage pulse SP applied to the electrodes associated with cell B thereby to generate quickly and maintain, stably, the discharge spot shifted from cell A at the adjacent discharge cell B. Thereafter, the wall charge associated with cell A can be removed or eliminated by applying an erase pulse to the discharge cell A. Simultaneously, the discharge spot now shifted to cell B can be maintained or, alternatively, the discharge spot can be shifted sequentially to the next successive discharge cell adjacent cell B (not shown in FIG. 2B), by performing a similar shift operation as above described.

Whereas the above shift operations have been described in relation to FIGS. 3A and 3B as being performed using positive going overlap and shift voltages OP and SP, negative such pulses may be employed in the alternative. In this instance, however, the result or effect of the pulse voltages is not as distinctive as that obtained when employing positive pulses. Specifically, in the case of negative pulses, the lateral field formed after the termination of the overlap pulse OP must function to promote the attraction into cell B of positive ions from the space charge generated by the priming discharge in cell A, for example, but the ions thus generated have less mobility than electrons. As a result, a delay in the shift of the discharge spot from cell A to cell B is likely to be encountered.

The overlap pulse OP employed in this invention has a pulse width $\tau 1$ and a voltage value V01, which values are selected to be sufficient for causing cell A to undergo a priming discharge and thereby to serve as a charge source cell for the shifting operation with respect to the adjacent cell B.

From a qualitative view point, the overlap pulse OP must be so selected that its pulse width $\tau 1$ is comparatively narrow and is in such relation to the timing that it falls in advance of the termination, or fall, of the shift voltage pulse SP. This serves to suppress the intensity of the priming discharge at cell A and thereby to minimize any undesired and unnecessary priming effect at remote discharge cells corresponding to that adjacent discharge cell B to which the discharge spot is to be shifted; corresponding cells are those associated with the corresponding shift electrodes in other groups thereof which, accordingly, receive simultaneously the same phase of the shift pulse voltage as that applied to the specific adjacent cell B which is to receive the discharge. An undesired priming effect extending to such remote, corresponding cells can cause misfiring, i.e., unintentional firing of those remote cells. Moreover, the relative times of termination of the overlap pulse OP and the shift pulse SP are such as to enhance the priming effect as to the adjacent cell which is to receive the shifted discharge spot, due to the lateral field created by the continuation of the shift pulse SP following termination of the overlap pulse OP.

Whereas these qualitative results are significant, in practical operation, quantitative parameters of the respective pulses must be set so as to maximize the shift operating margin as actually experienced in a practical panel, thus taking into account the discharge gap length, the composition of the gas mixture and the gas pressure in the panel shift operation to be driven, and other such characteristics as can be defined and confirmed empirically, i.e., experimentally, or in actual use.

Figure 4:
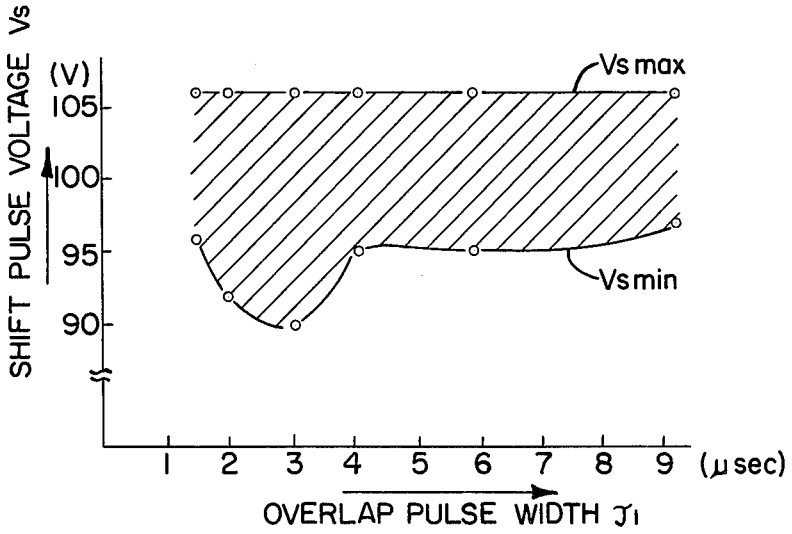
FIG. 4 is a plot of the pulse width or duration of the overlap pulse OP with respect to the amplitude of the shift pulse SP for illustrating the relationship therebetween in defining the shift operating margin.

FIG. 4 comprises a plot of the overlap pulse width $\tau 1$ as a function of the amplitude or level of the shift pulse voltage $Vs$, and has plotted therein characteristic curves established empirically in experiments for determining the minimum and maximum shift voltage levels $Vs_{min}$ and $Vs_{max}$, respectively, the region encompassed therebetween thus defining the shift voltage operating margin. Specifically, the pulse width $\tau 1$ of the overlap pulse OP is measured along the X axis while the amplitude, or level, of the shift pulse SP is measured along the Y axis. In this case, the overlap pulse OP and the shift voltage pulse SP are selected in such relation to each other as to rise, or initiate simultaneously and to have the same voltage amplitude value ($V01 = Vs$); moreover, the pulse width $\tau 2$ of the shift voltage pulse SP is selected to be 9μsec. The gas discharge panel subjected to this testing has dielectric layers comprising magnesium oxide (MgO) and has a discharge gap length of 120μm, the gas filling this space being a mixture of 0.1% Xe with residual Ne, and the Pd value, i.e., the product of gas pressure P and the discharge gap length $d$, is about 4 Torr.cm.

As is shown in FIG. 4, the shift operating margin comprising that range or region between the minimum shift voltage $Vs$min and the maximum shift voltage $Vs$max is dependent on the pulse width $\tau 1$ of the overlap pulse OP, that margin having a distinctive increase at its lower limit. In the specific panel tested, and in view of the experimental conditions indicated, it was observed that the maximum shift operating margin is achieved utilizing an OP pulse width $\tau$ of a value in the range of from 2 to 3.5μsec and more preferably about 3μsec, that maximum shift operating margin being about 50% greater than the margin outside of these preferred ranges.

It moreover has been determined that the optimum pulse width for the overlap pulse OP does vary as a function of discharge gap length and gas pressure, and particularly that the optimum width increases with an increase of the discharge gap length of the panel and decreases, i.e., becomes more narrow, with an increase of the gas pressure. Thus, for a variety of different panel design conditions, the optimum pulse width $\tau$ 1 of the overlap pulse OP has been observed to extend over a range of from 0.3 to 5μsec.

Lower limits do exist on the usable overlap pulse width. Specifically, if a pulse width becomes too short, relative to the time delay of establishing a discharge, the probability of achieving a discharge is reduced, and hence, the reduced priming effect reduces the operating margin; conversely, if the overlap pulse width becomes too great, charges generated by the discharge are attracted to the dielectric layers, reducing the amount of space charge, and hence, the beneficial priming effect with respect to the adjacent discharge cell to which the discharge spot is to be shifted.

In a panel employed for experiments, a desirable time duration for the application of a pulse to assure establishment of a proper wall charge is from 5 to 6μsec. Therefore, the pulse width $\tau 2$ of the shift voltage pulse SP is selected to be of a value greater than 5μsec.

Practical operating conditions employed in the experiment included setting the pulse width of the shift voltage pulse SP at 9μsec. and employing a narrow width erase pulse EP having the same voltage value as the shift pulse SP but a pulse width of 2μsec, the erase pulse EP being applied to the discharge cell after completion of the shift of the discharge spot to the adjacent cell. Typically, the erase pulse width is selected to be less than 2μsec. and a desirable range is from 1 to 2μsec. Therefore, in some circumstances, the optimum pulse width of the overlap pulse OP is or may be the same as the pulse width of the erase pulse.

A feature of the present invention is that of suppressing excessive priming discharge at the discharge cell from which a discharge spot is to be shifted, while at the same time intensifying the priming effect at the adjacent cell which is to receive the shifted discharge spot, by means of the lateral field. In achieving these desirable results, the invention permits the initiation, or rising, of the overlap pulse, OP to either precede or succeed, or coincide with, the initiation of the shift pulse SP, so long as the termination of the overlap pulse OP precedes that of the shift pulse SP.

Moreover, whereas it is desirable to select a voltage value of the overlap pulse OP which is the same as that of the shift pulse SP, especially for practical drive circuit considerations, the present invention also permits reducing the intensity of the priming discharge by employing a voltage value V01 for the overlap pulse OP which is less than that for the shift pulse SP.

Figure 5:
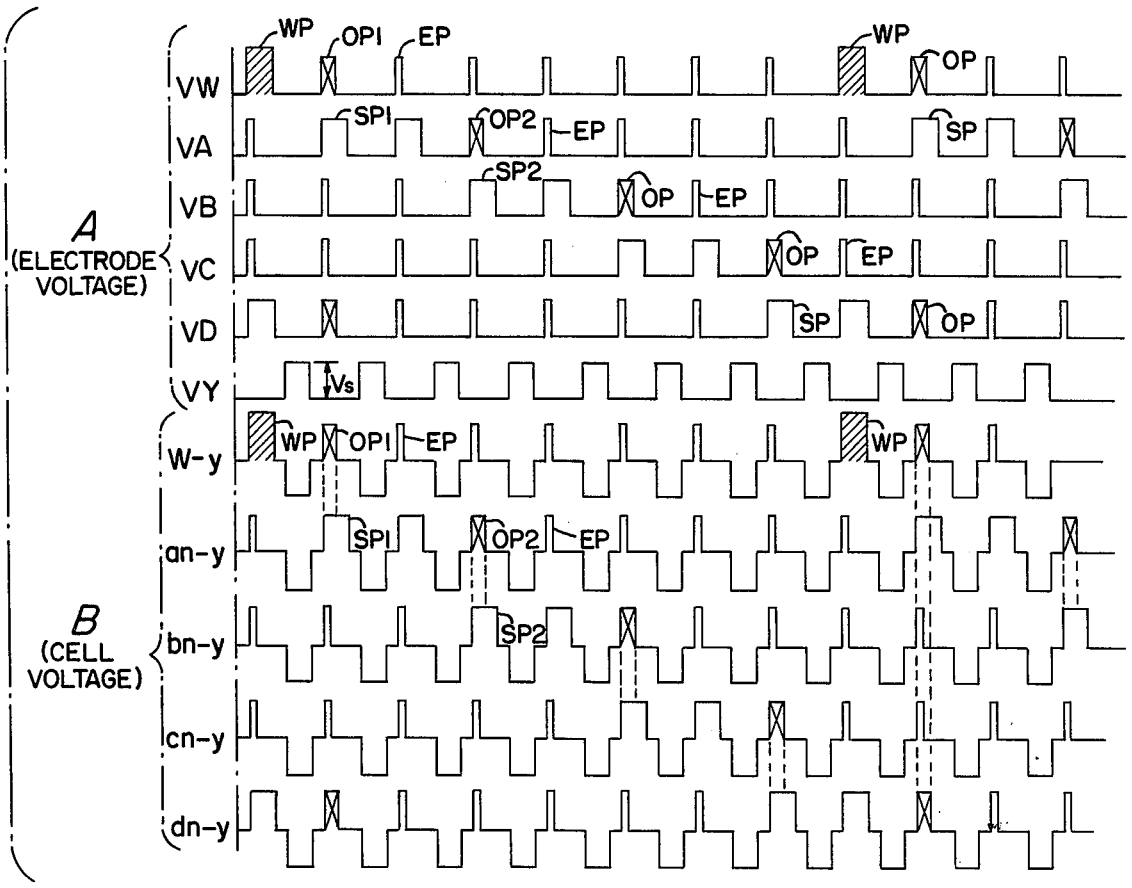
FIG. 5A are waveform plots of pulse voltages applied to various electrodes.
FIG. 5B is a plot of the cell voltages resulting from the electrode pulse voltages of FIG. 5A, and illustrate the shift operation method of the invention as applied to a self-shift plasma display panel as shown in FIG. 1.

FIG. 5A comprises a plot of voltage pulses to be applied to the various of the electrodes of the panel in FIG. 1, VW being applied to any selected one of the write electrodes $w1$ to $w5$ through their respective terminals W1 to W5, voltage VA–VD being applied to the terminals A–D of the shift buses BA–BD, respectively, and voltage VY being applied to the terminal Y of the common bus $Y_c$ associated with the common electrodes $y1$ to $y5$. FIG. 5B illustrates the waveforms of the cell voltages, or potentials, resulting from the voltage pulses of FIG. 5A and specifically with respect to the cells associated with the write electrode shown at $w$-$y$, and those associated with the successive groups of shift electrodes as shown at $an$-$y$ through $dn$-$y$, respectively. As to each of FIGS. 5A and 5B, the shift voltage pulses SP and, as well, the associated overlap pulses OP are applied in successive phases to the successive shift electrodes. Moreover, as is apparent from FIGS. 5A and 5B, the write voltage pulses WP, the overlap pulses OP (1, 2, . . . ), the shift voltage pulses SP (1,2, . . . ), the latter also used as the sustaining voltage pulses, and the narrow erase pulses EP are employed for driving the panel.

In operation, the write voltage pulse WP supplied to a given one of the write electrodes $w1$-$w5$ produces a discharge spot in the cell defined between that selected write electrode and the respectively associated one of the common electrodes *y1–y5*. Following the write operation, the ensuing overlap pulse OP1 in the VW waveform of FIG. 5A operates in association with the shift pulse SP1 in waveform VA to shift that discharge spot from the cell associated with the write electrode to the adjacent cell along the respectively associated common electrode *y* and the first shift electrode 21. As shown, the next or succeeding operation is a stabilization cycle in which the same shift pulse SP1 is supplied to that same shift electrode and simultaneously an erase pulse EP is supplied to the write electrode.

In the next cycle, overlap pulse OP2 of waveform VA and shift pulse SP2 of waveform VB serve to shift the discharge to the next adjacent discharge cell. The aforedescribed cycles of operation then continue in this manner, sequentially shifting the discharge spot to successive, next adjacent cells along the length of the common electrode. In view of the grouping of the shift electrodes and pulsing thereof through the respective common buses, it is convenient to refer to the overlap and the shift pulses as occurring in successive phases.

Figure 6:
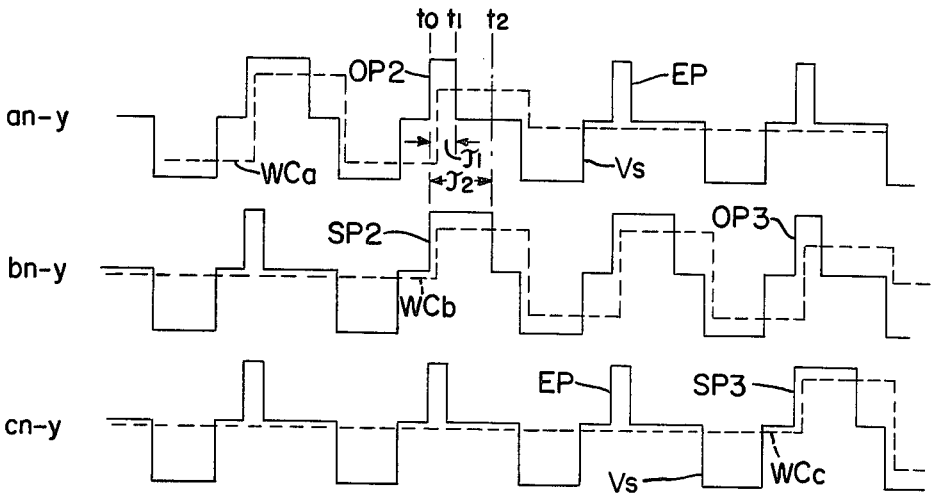
FIG. 6 comprises enlarged waveforms corresponding to cell voltages *an-y, bn-y,* and *cn-y* of FIG. 5B.

The cell voltages of FIG. 6 correspond to those identically labelled *an-y, bn-y,* and *cn-y* in FIG. 5B, and are enlarged to facilitate additionally showing the wall charge voltages W*ca,* W*cb* and W*cc* in the corresponding cells. The overlap pulses OP2 and OP3 are seen to produce a decreased wall charge compared to that produced by the shift pulses such as SP2 and SP3 (or the stabilizing pulses of like amplitude which follow the shift pulses in the cycle following a shift operation). The duration of the overlap pulses OP must be sufficient to produce the priming discharge, but need not produce a wall charge and may, in fact, produce a minimum value or even no wall charge.

After the overlap pulse terminates, and during the second half-cycle of the given phase, a sustain pulse V*s* applied to the common (*y*) electrode extinguishes the wall charge. The sustain pulse V*s* may or may not produce a discharge, depending on the amount of wall charge produced by the preceding priming discharge pulse OP2 of *an-y* in FIG. 6. As shown however, the wall charge has extinguished at V*s.* Should any wall charge remaining after V*s,* it is extinguished by the following EP of the next phase of *an-y.*

It is to be recognized that the above waveforms of the cell voltages primarily are illustrative and represent essentially idealized theoretical characteristics and are presented to assist in better understanding of the invention.

Figure 7:
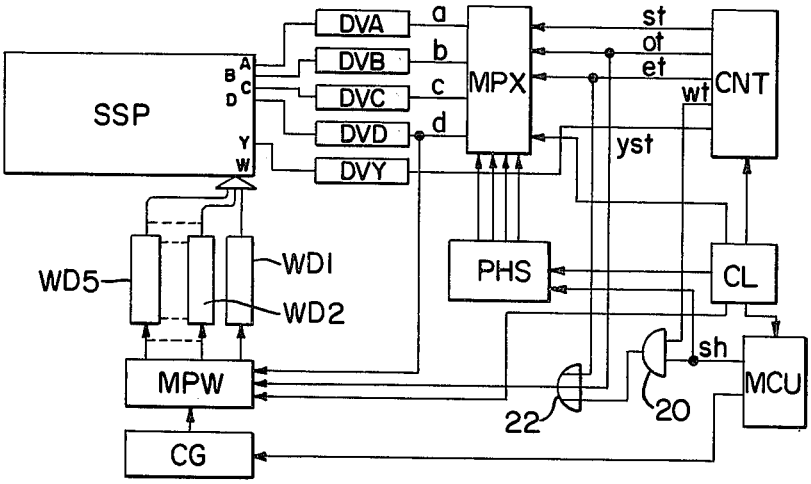
FIG. 7 is a block diagram of a system for driving a plasma display panel in accordance with the method of the present invention.

FIG. 7 is an illustrative block diagram of a driving circuit in accordance with the system of the invention. The four drivers DVA, DVB, DVC, and DVD are respectively connected to the shift bus terminals A, B, C, and D of the gas discharge panel SSP which may take the form of FIG. 1. These drivers DVA-DVD supply driving pulse trains such as shown at VA through VD, respectively, in FIG. 5A under control of the signal multiplexing circuit MPX which generates control pulses *a* to *d* having four different phases and serving correspondingly to shift a spot to the (four) successive discharge cells (*an* to *dn*) defined by the successive (four ) shift electrodes of each group (1 to *n*) thereof. The grouping of electrodes by four (4) and the corresponding use of four phases is desirable and practical, but not limiting. The multiplexing circuit MPX is responsive to the respective outputs of a timing control circuit CNT, a phase switching circuit PHS, and the clock source CL. The timing control circuit CNT outputs basic timing signals, *st, ot,* and *et* defining the timing functions (duration and synchronization) of the shift pulses SP, the overlap pulses OP, and the erase pulses EP. The phase switching circuit PHS generates gating signals for phase switching which thus define the phases in which appropriate ones of the shift, overlap and erase pulses are supplied by the multiplexer MPX to the drivers DVA to DVD. Each of the circuits CNT and PHS functions in response to a clock pulse train received from the clock pulse generator CL.

The timing control circuit CNT also supplies an output *yst* to the common electrode driver DVY, the output of which is supplied to the terminal Y for the common electrodes and specifically for generating the pulse train shown at VY in FIG. 5A.

The write electrodes *w1* to *w5*, corresponding to the shift channels and thus the respectively associated common electrodes *y1* to *y5*, are connected at their corresponding terminals W1 to W5 (shown collectively in FIG. 6 by the single terminal W) to the write drivers WD1 to WD5. The write drivers are controlled in operation by the multiplexing circuit MPW which generates a multiplex signal of the write timing signal *wt,* the overlap timing signal *ot,* and the erasing timing signal *et* supplied from the timing circuit CNT in accordance with data output signals from the character generator CG. Specifically, the information to be displayed in accordance with the outputs from the character generator CG control the multiplexer MPW to enable the appropriate ones of the write drivers WD1 to WD5 to generate the write pulse WP for application to the corresponding write electrodes, as required for display of the information supplied by the character generator CG. That character generator information, of course, is supplied at appropriate timed intervals under control of the multiplexer. Moreover, the shift output *sh* from the multiplexer is supplied through an AND gate 20, also receiving the write timing signal *wt* from the timing control circuit CNT, through an OR gate 22 to the multiplexer MPW, the OR gate 22 also supplying the timing signals *ot* and *et* therethrough to MPW.

In a preferred operation, the write pulse WP is selectively supplied to the appropriate write discharge cell for initiating a discharge during the cycle or interval of operation in which the shift electrode farthest from the write electrode is being activated. For the present illustrative embodiment having the shift electrodes arranged in groups of four, each group designated *a, b, c,* and *d,* the write voltage pulse WP would be applied while a shift pulse SP is applied to the *d* electrode; this alternatively can be expressed as the write pulse WP being applied during the D phase of the shift voltage SP, corresponding to the occurrence of the shift voltage SP in the pulse train VD simultaneously with VW, in FIG. 5A.

Similarly, the application of an overlap pulse OP to the write electrode is timed to correspond to that phase in which a shift voltage pulse SP is applied to the shift electrode closest to the write electrode. In the illustrative example herein, this occurs when the shift voltage pulse SP is applied to the *a* electrode as may be seen from the waveforms VW and VA of FIG. 5A.

Whereas a useful and practical embodiment of the present invention has been set forth hereinabove, it will be apparent to those of skill in this field that various modifications and combinations can readily be made.

For example, the system and method of the invention may be used not only with a self-shift panel of the type shown in FIG. 1, but also to a gas discharge panel having a parallel electrode configuration as disclosed in U.S. Pat. No. 3,775,764 to J. P. Gauer, entitled "MULTI-LINE PLASMA SHIFT REGISTER DISPLAY" and to a gas discharge panel having a crossed electrode configuration in a special pattern particularly as is shown in FIG. 10 of U.S. Pat. No. 3,704,389 to W. B. McClelland, entitled "METHOD AND APPARATUS FOR MEMORY AND DISPLAY".

It will be understood, of course, that for purposes of explanation of the present invention, FIG. 1 has illustrated a panel having only a few representative common, write, and shift electrodes; clearly, this is not limiting, and in any panel of any desired size and number of such electrodes could be employed. Likewise, the invention is not restricted to use with a four-phase system having the shift electrodes arranged in groups of four but instead is applicable to other panels having different such phasing or grouping arrangements.

Accordingly, the present invention provides a method and system of operation for shifting a discharge spot which is highly effective for increasing the shift operating margin of such a gas discharge panel and, moreover, affords a noticeable and significant advantage, or improvement, in attaining stable, accurate, and high speed shift operations. Thus, it is intended by the appended claims to cover all such modifications and adaptations which fall within the true spirit and scope of this invention.

What is claimed is:

1. A method of shifting a discharge spot in an A.C. type gas discharge panel having at least one common electrode covered by a dielectric material and disposed on a first substrate and at least first and second further electrodes spaced from each other disposed on a second substrate to face to said common electrode and covered by a corresponding dielectric surface, said dielectric surfaces of said common electrode and said further electrodes being spaced from each other to define therebetween a gas discharge space with said first and second further electrodes facing said common electrode across said discharge space to define corresponding first and second adjacent gas discharge cells, comprising the steps of:

establishing a discharge spot in said first cell, applying a priming discharge pulse of a given polarity and first predetermined duration to said first further electrode to produce a priming discharge in said corresponding first cell with respect to said adjacent second cell, applying a shift pulse of said given polarity to said second further electrode of a second, longer duration than said first predetermined duration, and terminating said priming discharge pulse prior to termination of said shift pulse, said shift pulse thereby producing a lateral field between said first and second cells for transferring to said second cell components of the priming discharge of said first cell, thereby to facilitate the initiation of a discharge at said second cell for shifting said discharge spot to said second cell.

2. A method as recited in claim 1 wherein said discharge in said second cell establishes a wall voltage therein, further comprising:

applying a sustain pulse of said given polarity to said common electrode after termination of said shift pulse to establish an alternate discharge in said second cell and thus to produce a corresponding, alternate wall charge therein, and applying a stabilizing pulse of said given polarity to said second further electrode after termination of said sustain pulse for stabilizing said discharge at said second discharge cell.

3. A method as recited in claim 2 further comprising:

selecting the amplitude and duration of each of said sustain and stabilizing pulses to be the same as the amplitude and duration of said shift pulse.

4. A method as recited in claim 1 further comprising:

selecting said priming discharge pulse and said shift pulse to be of a common voltage level.

5. A method as recited in claim 1 further comprising selecting the predetermined duration of said priming discharge pulse to be in the range of 0.3 to 5 microseconds.

6. A method as recited in claim 5 further comprising selecting the predetermined duration of said priming discharge pulse to be in the range of 2 to 3.5 microseconds.

7. A method as recited in claim 6 further comprising selecting the predetermined duration of said priming discharge pulse to be of approximately 3 microseconds.

8. A method as recited in claim 1 further comprising selecting the duration of the shift pulse to be approximately 9 microseconds.

9. A method as recited in claim 1 wherein the voltage value of the priming discharge pulse is selected to be less than the voltage value of the shift pulse.

10. A method as recited in claim 1 wherein each of said priming discharge pulse and said shift pulse are of positive polarity, whereby said lateral field produced by said shift pulse upon termination of said priming discharge pulse serves to attract electrons from the priming discharge of said first cell to said adjacent second cell.

11. A method as recited in claim 1 wherein said shift pulse duration is sufficient for the discharge produced in said second cell to establish a wall charge for sustaining the shifted discharge spot in said adjacent cell in A.C. operation of said panel, further comprising:

selecting the predetermined duration of said priming discharge pulse to be sufficient to produce a discharge at said first cell but insufficient to produce any substantial wall charge in said first cell.

12. A method as recited in claim 11, further comprising:

applying an erase pulse of said given polarity and of a duration no greater than said first predetermined duration to said first further electrode, after termination of said shift pulse, to extinguish any wall charge in said first discharge cell.

13. A method as recited in claim 12 further comprising:

selecting said priming discharge pulse, said shift pulse, and said erase pulse to be of common polarity.

14. A method as recited in claim 12, further comprising:

selecting the duration of said shift pulse to be a minimum of five microseconds, the duration of the priming discharge pulse to be no greater than 5 microseconds, and the duration of the erase pulse to be no greater than 2 microseconds or less.

15. A method as recited in claim 14 further comprising selecting the duration of the priming discharge pulse to be in the range of 0.3 to 5 microseconds.

16. A method as recited in claim 1 wherein said panel has plural said common electrodes extending in generally parallel relation in a first direction and plural, successive said further electrodes extending in generally parallel relation in a second, transverse direction, each of said successive, further electrodes defining corresponding discharge cells at the intersections thereof with said common electrodes, the successive said further electrodes respectively defining successive discharge cells at the intersections thereof with said common electrodes, said further electrodes being arranged in groups of corresponding said further electrodes, a priming discharge pulse and a shift pulse being applied in each of successive phases to respective, adjacent successive electrodes of each group, simultaneously for all such groups, the number of phases being equal to the number of electrodes of each group, the method further comprising:

selectively establishing discharge spots in the cells associated with a given, further electrode, and shifting said selectively established discharge spots to successive said cells in corresponding, successive phases, by applying said priming discharge pulse to the further electrode associated with discharge cells in which discharge spots are established and said shift pulse to the next successive further electrode for shifting the selectively established discharge spots to respective, adjacent discharge cells, in each phase, and in a continuing sequence of the successive phases for all successive discharge cells corresponding to said successive further electrodes.

17. A method as recited in claim 16 wherein said shift pulse duration is sufficient for each shifted discharge spot to establish a wall charge in each of said respective, adjacent discharge cells to which a spot is shifted, for sustaining each such shifted discharge spot in A.C. operation of said panel, further comprising, in each phase:

applying a sustain pulse of said given polarity to all said common electrodes following termination of said shift pulse to produce an alternate discharge in each said respective, adjacent discharge cell to which a spot is shifted and thus to establish a corresponding alternate wall charge therein, and applying a stabilizing pulse to said respective, adjacent further electrode to produce a further discharge at said second cell, thereby to stabilize each said shifted discharge spot at said respective, adjacent discharge cell.

18. A method as recited in claim 17 wherein the operating margin for shift operations is defined in relation to the pulse duration of said priming discharge pulse in accordance with the minimum amplitude value of said shift pulse required for establishing the discharge spots at said cells to which said discharge spots are shifted in a given phase, and in accordance with a maximum amplitude value, the application of a shift pulse in excess of said maximum amplitude value producing unintentional firing at a corresponding cell of a different group defined by an electrode energized simultaneously in said given phase by the same said shift pulse, further comprising selecting the duration of said timing discharge pulse to be within a range in which said operating margin is of maximum value.

19. The method as recited in claim 1, wherein for a given panel having a predetermined gas pressure, said first predetermined duration of said priming discharge pulse is the optimum value thereof, further comprising reducing said first predetermined duration of said priming discharge pulse for an increase in gas pressure of said given panel, thereby to provide said optimum value of said priming pulse duration for said given panel for a given, relatively increased gas pressure.

20. A method as recited in claim 17 wherein, for a given panel having a given discharge gap length and a given gas pressure establishing a given optimum value of said first predetermined duration of said priming discharge pulse, said method further comprises: selecting the pulse duration of the priming discharge pulse for a further panel having a greater discharge gap length for the same gas pressure as said given panel is selected, in accordance with increasing the duration of said priming discharge pulse relative to said first predetermined duration for said given panel.

21. A method of shifting a discharge spot in an A.C. type discharge panel having at least one common electrode covered by a dielectric material and at least first and second further electrodes spaced from each other and covered by a corresponding dielectric surface, said dielectric surfaces of said common electrode and said further electrodes being spaced from each other to define therebetween a gas discharge space with said first and second further electrodes facing said common electrode across said discharge space to define corresponding first and second adjacent gas discharge cells, comprising establishing a discharge spot in said first cell, applying a priming discharge pulse of a given polarity to said first further electrode to produce a priming discharge in said corresponding first cell with respect to said adjacent second cell, applying a shift pulse of said given polarity to said second further electrode, terminating said priming discharge pulse and, thereafter, terminating said shift pulse thereby to produce a lateral field between said first and said second cells for transferring to said second cell components of the priming discharge of said first cell, thereby to facilitate the initiating of a discharge at said second cell for shifting said discharge spot to said second cell, selecting the duration of said shift pulse to be sufficient to establish said discharge at said second cell and to produce a wall charge in said second cell sufficient for sustaining the discharge therein in A.C. operation of said panel, and selecting the duration of said priming discharge pulse to be sufficient to produce said priming discharge but insufficient to produce any substantial wall charge in said first cell, through the time of termination of said priming discharge pulse.

22. A method as recited in claim 20 further comprising selecting the duration of said priming discharge pulse to be less than that of said shift pulse.

23. A method of shifting a discharge spot in an A.C. type discharge panel having plural common electrodes extending in generally parallel relation in a first direction and plural, successive shift electrodes extending in generally parallel relation in a second direction transverse to said first direction, said successive shaft electrodes defining respective, successive discharge cells at the intersections thereof with said common electrodes, said shift electrodes being arranged in groups with respectively corresponding shift electrodes of the successive groups thereof connected for simultaneous application of electrical pulses thereto, comprising:

selectively establishing discharge spots in the cells associated with a given shift electrode, applying, in each of a succession of phases corresponding in number to the number of shift electrodes in each group, a pulse of a given polarity and first predetermined duration to said shift electrode associated with the cells in which discharge spots are selectively established, to produce a priming discharge in those cells having established discharge spots for priming respective, next adjacent successive cells, applying a shift pulse of said given polarity to said next successive electrode of a second duration overlapping for at least a portion of the duration thereof the said first predetermined duration of said priming discharge pulse, terminating the priming discharge pulse prior to termination of said shift pulse, said shift pulse thereby shifting the established discharge spots from the first said cells to the respective, adjacent cells associated with said shift electrode receiving said shift pulse, selecting the amplitude value of said shift pulse to be less than a maximum value, above which the priming effect of the priming discharge of said cell associated with said given shift electrode will cause unintentional firing of a remote cell associated with the corresponding shift electrode of a different group thereof, and controlling the duration of the timing discharge pulse, with respect to the amplitude value of said shift pulse, to afford a priming discharge affecting said next adjacent successive cells to which a discharge spot is to be shifted permitting use of a minimum amplitude value of the shift pulse, thereby to maximize the shift operating range of said panel.

24. A method as recited in claim 23 further comprising selecting the predetermined duration of said priming discharge pulse to be in the range of 0.3 to 5 microseconds.

25. A method as recited in claim 24 further comprising selecting the predetermined duration of said priming discharge pulse to be in the range of 2 to 3.5 microseconds.

26. A method as recited in claim 25 further comprising selecting the predetermined duration of said priming discharge pulse to be approximately 3 microseconds

27. A method as recited in claim 23 further comprising selecting the duration of the shift pulse to be approximately 9 microseconds.

28. A driving system for a gas discharge panel having plural common electrodes extending in parallel relation in a first direction and covered by a dielectric material, plural shift electrodes extending in generally parallel relation transversely to said first direction, and individual write electrodes extending in said second direction transversely of said first direction and respectively corresponding to said common electrodes, said shift and said write electrodes being covered by a corresponding dielectric surface and said dielectric surfaces being spaced from each other to define therebetween a gas discharge space with the write electrodes intersecting the respective common electrodes to define write discharge cells and said successive shift electrodes intersecting said common electrodes to define respective, successive discharge cells, said shift electrodes being arranged in groups of a predetermined number of electrodes per group with the corresponding electrodes of all groups connected to respective common terminals for energization simultaneously by pulses applied to said common terminals, said common terminals and thus the respective, corresponding electrodes of all of said groups being energized selectively in a succession of phases defining a phase time sequence and corresponding in number to the number of electrodes in each group, in a continuous repeating cycle of said phases, comprising:

clocking means generating a clocking signal defining the time sequence of said phases, first means for generating a first pulse train of write pulses, a second pulse train of shift pulses, a third pulse train of priming discharge pulses, and a fourth pulse train of erase pulses, the pulses of each said train being synchronized with said phase time sequence, second means for generating a master shift pulse defining an initial phase of each repeating cycle of the phases, third means responsive to said clocking signal, to said first, third and fourth pulse trains, and to said master shift pulse for generating a first multiplex pulse train including a write pulse, a priming discharge pulse, and an erase pulse in said phase time sequence for application to said write electrodes, thereby to establish discharges in selected said write discharge cells, fourth means responsive to said clocking signal, to said second, third and fourth pulse trains and to said master shift pulse for generating a sequence of multiplex shift control pulse trains respectively corresponding to successive phases of each cycle for application to the respective, shift electrodes of said groups in said phase time sequence, each of said multiplex shift control pulse trains comprising a shift pulse, a priming discharge pulse, and an erase pulse in said phase time sequence, said first means controlling the duration of said priming discharge pulse to be less than that of said shift pulse and sufficient to establish a priming discharge in a discharge cell without producing any substantial wall voltage therein, and the duration of said shift pulse being sufficient to establish a discharge in a discharge cell by transferring, subject to the priming effect of said priming discharge, the discharge spot from an adjacent discharging cell, and said fourth means supplying said sequences of multiplex shift control pulse trains to said respective, corresponding shift electrodes of said groups for shifting discharges established in said panel to the successive discharge cells of said panel.

29. A system as recited in claim 28 wherein there is further provided:

means for supplying information to be displayed in said panel, and said third means being responsive to said information for selectively supplying said first multiplex pulse train to corresponding ones of said write electrodes, thereby to establish discharges in the associated write cells in accordance with the information to be displayed.

30. A system as recited in claim 28 wherein said second means controls the duration of said shift pulses to be approximately 9 microseconds, and controls the duration of said priming discharge pulses to be in the range from 0.3 to 5 microseconds.

31. A system as recited in claim 30 wherein said second means controls the duration of said priming discharge pulse to be in the range from 2 to 3.5 microseconds.

32. A system for shifting a discharge spot in an A.C. type gas discharge panel having at least one common electrode covered by a dielectric material and extending in a first direction and at least first and second further electrodes spaced from each other extending in parallel relation in a second direction transversely to said first direction and covered by a corresponding dielectric surface, said dielectric surfaces of said common electrode and said further electrodes being spaced from each other to define therebetween a gas discharge space with said first and second further electrodes intersecting said common electrode across said discharge space to define corresponding first and second adjacent gas discharge cells, comprising first means for establishing a discharge spot in said first cell, second means for applying a priming discharge pulse of a given polarity and first predetermined duration to said first further electrode to produce a priming discharge in said corresponding first cell with respect to said adjacent second cell, and third means for applying a shift pulse of said given polarity to said second further electrode of a second, longer duration than said first predetermined duration, whereby said priming discharge pulse terminates prior to termination of said shift pulse, said shift pulse thereby producing a lateral field between said first and second cells for transferring to said second cell components of the priming discharge of said first cell, thereby to facilitate the initiation of a discharge at said second cell for shifting said discharge spot to said second cell.

33. A system as recited in claim 32 wherein: said second means controls the predetermined duration of said priming discharge pulse to be in the range of 2 to 3.5 microseconds.

34. A system as recited in claim 33 wherein said second means controls the predetermined duration of said priming discharge pulse to be in the range of 2 to 3.5 microseconds.

35. A system as recited in claim 34 wherein said second means controls the predetermined duration of said priming discharge pulse to be approximately 3 microseconds.

36. A system as recited in claim 32 wherein said third means controls the duration of the shift pulse to be approximately 9 microseconds.

* * * * *

UNITED STATES PATENT AND TRADEMARK OFFICE

CERTIFICATE OF CORRECTION

PATENT NO. : 4,109,181

DATED : August 22, 1978

INVENTOR(S) : Kenji Murase et al

It is certified that error appears in the above-identified patent and that said Letters Patent are hereby corrected as shown below:

Column 6, line 2, "ovelap" should be --overlap--.
Column 6, line 9, delete "λ".
Column 7, line 42, "Torr.cm" should be --Torr·cm--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*